United States Patent [19]

Shonka

[11] Patent Number: 4,505,046

[45] Date of Patent: Mar. 19, 1985

[54] PRE-PRESS MAKEREADY SCALE FOR ROTARY PRESSES

[75] Inventor: Leonard G. Shonka, Glendale, Calif.

[73] Assignee: Systems and Methods, Inc., Los Angeles, Calif.

[21] Appl. No.: 495,138

[22] Filed: May 16, 1983

[51] Int. Cl.[3] ..... B41B 1/00

[52] U.S. Cl. ..... 33/184.5; 33/485

[58] Field of Search ..... 33/181 R, 182, 184.5, 33/483, 484, 485, 491, 494

[56] References Cited

U.S. PATENT DOCUMENTS

| | | | |
|---|---|---|---|
| 1,600,028 | 9/1926 | Wensel | 33/184.5 |
| 1,965,216 | 7/1934 | Brown | 33/184.5 |
| 2,559,533 | 7/1951 | Daniels | 33/184.5 |
| 2,682,463 | 6/1954 | Olsen | 33/184.5 |
| 3,330,210 | 7/1967 | Hobbs et al. | 33/184.5 |
| 3,594,910 | 7/1971 | Ross | 33/184.5 |
| 4,177,730 | 12/1979 | Schriber et al. | 33/184.5 |

FOREIGN PATENT DOCUMENTS

| | | | |
|---|---|---|---|
| 273443 | 7/1927 | United Kingdom | 33/485 |

*Primary Examiner*—Richard R. Stearns

*Attorney, Agent, or Firm*—Harlan P. Huebner

[57] ABSTRACT

A pre-press portable makeready guide for use with any rotary offset press to prepare the press to print documents. The guide includes visual indicia placed thereon as a guide to the operator of the press for settings of various components of the press to carry our printing and other operations. The scale may be rigid or flexible. If the scale is flexible a holder may be used and guide mounted and indexed thereon.

3 Claims, 6 Drawing Figures

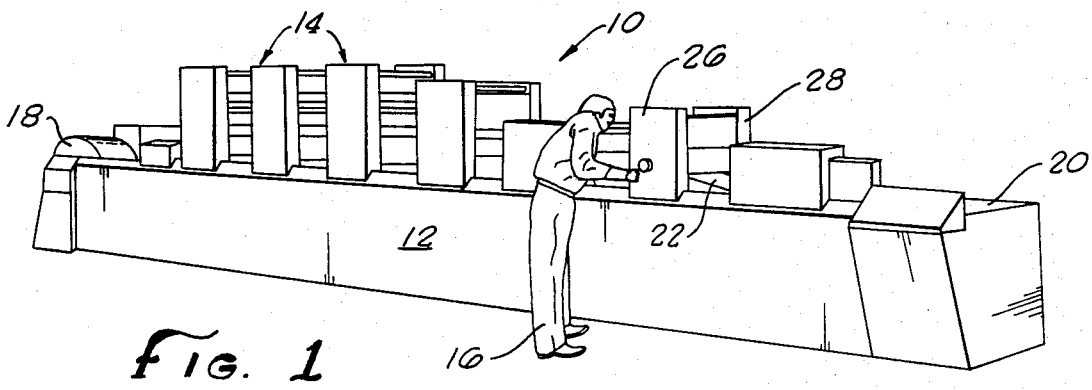
FIG. 1
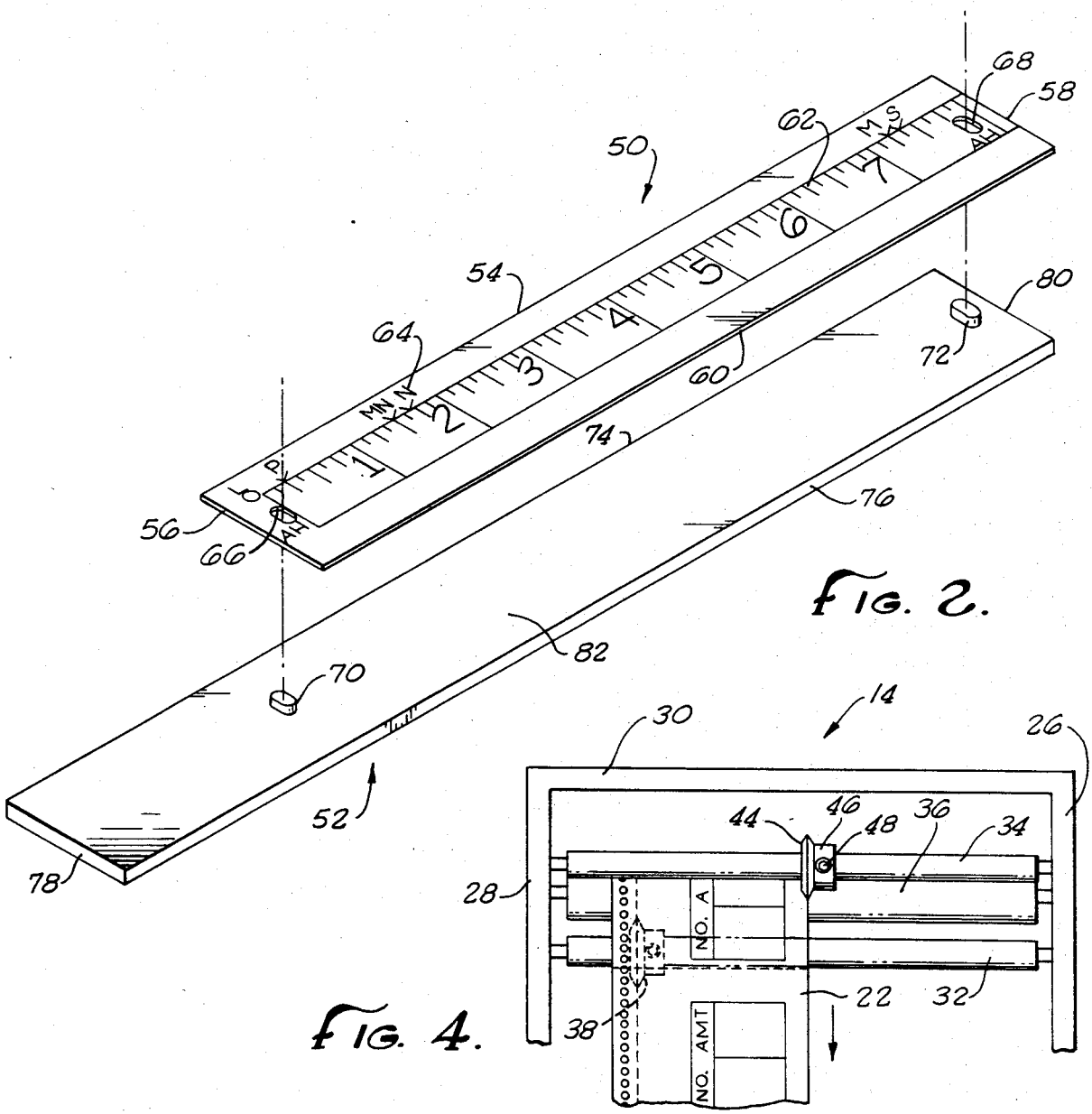
FIG. 2.
FIG. 4.

PRE-PRESS MAKEREADY SCALE FOR ROTARY PRESSES

BACKGROUND OF THE INVENTION

The present invention relates to a scale for use with a rotary offset printing press whereby certain settings may be made on the press directed to certain functions in the printing and preparation of business forms such as consecutive number printing, line holes, scoring, etc.

Generally, rotary offset printing presses contain a number of stations or towers to perform different functions when printing and binding such things as business forms. In the case of multiple forms, which may be of different colors, rolls of paper depending on the number of copies, and in some cases carbon paper, are positioned at the entry end of the press one above the other. The paper is fed into a first station where as an example certain printing functions maybe performed. The printing matrix is mounted on a drum, and as it rotates the paper is printed as it passes. As the form progresses another station may punch marginal holes in the form. Another station trims the marginal edge to size, and still another may form perforations. Thus when the form emerges at the exit end it is completely printed, scored, collated if copies are necessary and bound together.

In order to accomplish the various steps necessary for producing the finished form various manual settings of press equipment are required at the various stations.

Heretofore, the operator of the press has been required to take a measurement, i.e., from the margin to the center of marginal holes off of a form mockup, with a ruler and then go to the station and manually move the hole punch, etc. This has been time consuming and could result in incorrect measurement and setting.

On the other hand, where some presses are equipped with permanent guides they must be out of the way from the equipment and these are at a distance making adjustments of the equipment subject to error.

SUMMARY OF THE INVENTION

It is accordingly an object of the invention to provide a portable makeready scale made in pre-press planning that can be used for each tower setting of a rotary offset press for the printing, binding or cutting operation in preparing printed documents such as a form.

It is another object of the invention to provide a makeready scale that can be used on all existing rotary offset presses without the need to modify the press.

A further advantage is that the makeready scale can be indexed to fit onto a rigid scale holder and is portable to be carried by the press operator.

Another advantage to the invention is that the appropriate setting marks on the makeready scale are accomplished in the planning department having the benefit of a mockup of the document in front of the planner, and the scale will accompany a job ticket to the press.

Yet another object of the invention is to provide a makeready scale of any desired length, depending on the lateral width of a tower or station of the rotary offset press.

A further object is to appropriately mark adjacent the marginal edge of a makeready scale indicia whereby the pressman may move and align, hole punches, perforation cutters, trims etc. at the various press stations to the proper setting to accomplish a complete and finished business form and that it corresponds in all respects to the mockup.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is an environmental view showing a rotary offset press and how the invention would be used;

FIG. 2 is a perspective exploded view of the makeready scale and a holder means;

FIG. 4 is a view similar to FIG. 3, but illustrating the marginal edge of the form being trimmed and opposite side being perforated;

DETAILED DESCRIPTION OF THE PREFERRED EMBODIMENTS

Figure 3:
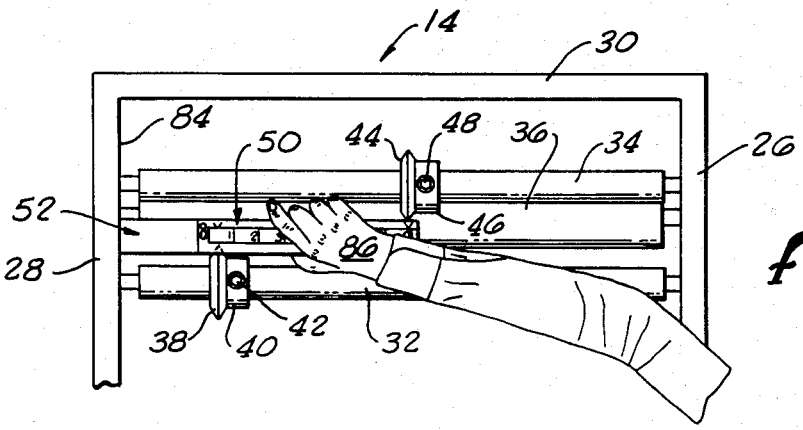
FIG. 3 is a front-side elevation view looking into one of the towers or stations of a rotary offset press showing the use of the makeready scale.

Referring to the drawings in more detail, as shown in FIG. 1 there is illustrated a conventional rotary offset printing press generally designated 10. The press 10 usually includes a bottom elongated frame member (not illustrated) covered with a skirt or cover 12. Mounted on the frame are various motors and gears whereby the printing, binding and cutting equipment in stations or towers designated 14 are driven. The side where the pressman 16 is standing is referred to as the operator's side and the opposite side is referred to as the gear side.

The rotary offset press 10 includes a start end 18 and a finish end 20. In practice, rolls of paper are mounted near the start end 18 and then the paper roll or rolls are threaded through the various towers 14 and when the rolls emerge at the finish 20 the particular business form generally designated 22 in roll form or cut will be deposited in an appropriate receptical (not shown).

Figure 5:
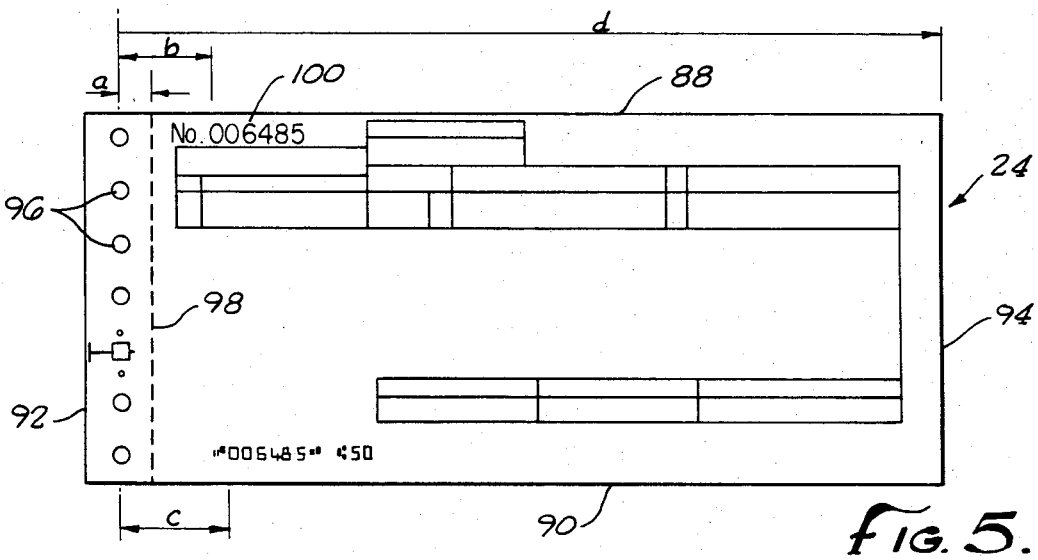
FIG. 5 is a mockup of a business form illustrating various dimensions which are required to be set on a rotary offset press to accomplish the desired operations.

For sake of illustration the business forms 22 described in the application in its final form will resemble the mockup business form 24 shown in FIG. 5.

Generally speaking the tower or towers 14 near the start end 18 will perform the printing operations on the form 22, wherein the towers toward the finish 20 perform bindery, hole punching, perforating, scoring, cutting or splitting operation In order to perform certain functions, on the business form 22 the press equipment within a tower 14 must be adjusted. The adjustment must be done physically by the pressman 16 from the operator's side of the press 10.

Again for the sake of illustration only FIGS. 3 and 4 depict a station or tower crosswise or showing its lateral width with the form 22 passing therethrough. Generally, the tower includes a pair of spaced apart vertical walls 26 and 28 with a top horizontal wall 30. Extending between the walls 26 and 28 and journalled in appropriate sockets or gears are rollers 32, 34 and 36.

In the particular views FIGS. 3 and 4, two functions may be performed at the same tower. Mounted on the roller 32 is a perforation wheel 38 which includes a collar 40 containing a set screw 42.

Mounted on roller 34 is a margin cutting wheel 44 which includes a collar 46 containing a set screw 48.

As can be seen, the respective perforator 38 and margin cutter 44 can be laterally shifted to a position to accomplish the intended function on the form 22 and set in place by the set screw. In some presses the adjustment can be accomplished by an exterior adjustment wheel.

In order to make the press 10 ready for printing and performing other physical functions a scale including a makeready measurement guide 50 is utilized. Preferably the guide 50 is flexible and inexpensive of manufacture and includes a stiff backing member or holder 52 to which the guide 50 may be secured.

The guide 50 includes at least one elongated straight edge 54 and opposed ends 56 and 58. The other edge 60 does not have to parallel the opposite edge 54. The guide 50 itself may be formed of paper, card stock or plastic or any material that can receive printed indicia. In the illustration in FIGS. 2 and 6 there is printed thereon an incremental scale 62, which can be used by the planner to place thereon the proper makeready indicia 64.

In addition to the above, the guide 50 includes indexing means or holes 66 and 68 which may be formed at any location on the guide 50. The purpose of the holes 66 and 68 are to fit over indexing projections 70 and 72 on the holder 52.

The holder 52 is preferrably made of metal, wood or plastic and is elongated of a length greater than the guide 50. The member 52 includes opposed elongated edges 74 and 76 and edges 78 and 80 and the top surface 82 is generally flat. The index projections 70 and 72 preferably correspond to the shape of the holes 66 and 68 and project upwardly from the surface 82.

Figure 6:
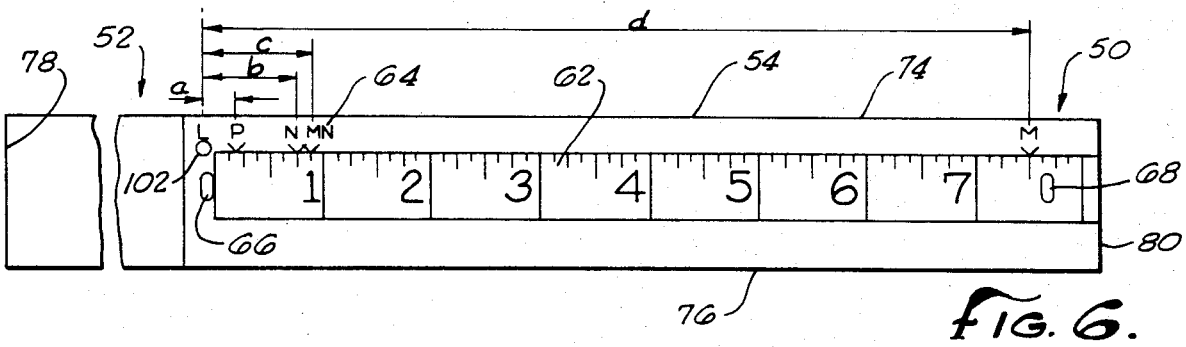
FIG. 6 is a detailed view of the makeready scale of this invention illustrating various markings, indicia and dimensions corresponding to the dimension of the form in FIG. 5.

As seen in FIGS. 2, 3 and 6 the member 52 is longer than the guide 50. This is by design and preferred to the proper function and operation of the guide 50. The distance between the end 78 of the member 52 and the end 56 of the guide 50 represents the distance from the inside 84 of the vertical wall 28 of the station 14 to a zero point on the rollers of a station. Thus the holder 52 is held by the pressman 16 by his hand 86 with the end 78 butted against the surface 84 and the edge 54 can represent the zero point.

In order to properly program or mark the guide with indicia 64 the mockup 24 of the form is needed. Usually the form is designed in by a planner and physical mockup 24 is made. In some cases it may be that the form needs reprinting and an actual form is used for the measurements. For purposes of identification the mockup of FIG. 5 includes elongated top and bottom edges 88 and 90 and opposed end edges 92 and 94. There are also a plurality of line holes 96, a perforation line 98 and a series of numbers 100. This particular form would represent a form with a number of copies which when bound together and could be separated along the perforation line 98.

After the mockup 24 is completed the programmer or planner then makes his measurements. As an example the letter "L" on the scale 50 in FIG. 6 would represent the measurement from the zero line to the center of the line holes 96. At that point the planner would punch a hole 102 and print the letter "L" thereabove. Next the measurement "a" is taken, the center line of holes 96 to the perforation and mark or "v" mark is made on the scale with the letter "p" thereabove to represent the location or setting of the perforation wheel 38 on the roller 32.

Next the measurement "b" might be placed on the scale with a "v" mark and the letter "N" to indicate where the start of sequential numbering should be set on the press 10.

The same is true of the "c" and "d" measurements with the indicia such as "MN" and "M".

The code on the guide 50 is of course known to the pressman.

The guide 50 after it is completed can then be attached to a work order and submitted to the pressman 16. It can also be preserved with the work order for future reuse when the forms are to be reprinted.

The pressman 16 then inserts the guide 50 on the member 52 and indexes the holes 66 and 68 on the projections 70 and 72. He then goes to a station 14, see FIG. 3 and places the makeready guide 50 and holder 52 in the position shown, loosens set screw 42 and shifts the perforator wheel aligning it with the "v" and resets the screw 42 for, in this case, making the perforation lines 98.

The pressman 16, working from the operator's side, removes the guide and holder and moves to the next station making his adjustments depending on the indicia 64 on the scale. When all the settings are made the scale and holder are removed and stored or carried by the pressman and the rotary offset press 10 is ready for operation.

While the guide 50 is shown as about eight inches in length the length can vary depending on the size of the form limited only to the internal lateral dimension of the tower or station 14.

The guide 50 does not have to be made of flexible material. If it should be made of rigid material then the need for the holder is eliminated. However, the length of the guide 50 would then have to be increased to take up the distance from tower wall 28 to the zero point.

It is apparent from the foregoing that a new and improved makeready scale has been provided. This article is relatively inexpensive to produce, yet has the capability of being adapted or used on any existing rotary offset press. While only the presently preferred embodiment has been described herein, certain changes and modifications can be made without departing from the scope of the invention as defined by the following claims.

I claim:

1. A portable pre-press makeready scale for accomplishing the setting of adjustable mechanisms at stations having lateral widths of a rotary offset printer wherein the functions of printing, punching, perforating, binding and cutting or any combination thereof are to be performed to print and finish a series of a single document comprising:

a single elongated guide containing visable preselected code symbol settings located at predetermined positions for setting the functions necessary to form said single document; said guide having indexing holes;

a reusable elongated holder including indexing projections to mate with the indexing holes of said guide to releasably hold said single guide in place thereon; and said holder and guide are of lengths to interfit within the lateral width of a station and once the adjustments of the mechanism at that said station are made corresponding to a particular code symbol setting said holder and guide may be moved to interfit within subsequent stations for appropriate mechanism settings against other of said code symbols.

2. A pre-press makeready scale as defined in claim 1 wherein:

said holder is longer than said guide and the excess length services as a lateral spacer to orient said elongated reusable guide with respect to said adjustable mechanisms of said stations.

3. A method of preparing a portable pre-press makeready scale for insuring the proper settings of press equipment at various stations of a rotary offset press for the functions of printing, punching, perforating, binding and cutting or any combination thereof including the steps of:

selecting a sample business form to be printed in large quantities on said press;

determining various press functions to be performed at said stations in preparation of said form;

taking measurements related to said press functions off of said sample form;

selecting an elongated reusable single guide having at least one straight elongated edge and containing an incremental scale adjacent said edge; and transporting said measurements to said elongated guide by using said incremental scale;

placing code symbol settings for said press equipment at predetermined positions on said guide between said straight edge and said incremental scale using said measurements;

mounting said elongated reusable single guide on a reusable elongated holder having guide indexing means; and moving said single guide and holder from station to station to make the equipment settings for producing a finished form.

* * * * *